United States Patent [19]

Hirst

[11] 4,009,861

[45] Mar. 1, 1977

[54] STEP OPENING GAS VALVE

[75] Inventor: Paul A. Hirst, Riverside, Calif.

[73] Assignee: Essex International, Inc., Fort Wayne, Ind.

[22] Filed: Feb. 4, 1976

[21] Appl. No.: 655,050

[52] U.S. Cl. ..... 251/61.1; 251/210; 137/495; 251/30

[51] Int. Cl.[2] ..... F16K 17/10; F16K/31/145

[58] Field of Search ..... 137/495, 489, 497.5; 251/30, 61.1; 138/45, 46; 251/211, 210, 120, 121

[56] References Cited

UNITED STATES PATENTS

| | | | |
|---|---|---|---|
| 1,379,694 | 5/1921 | Pownall | 137/529 X |
| 3,880,186 | 4/1975 | Turner | 137/495 |

*Primary Examiner*—Alan Cohan
*Attorney, Agent, or Firm*—Robert D. Sommer; Lawrence E. Freiburger

[57] ABSTRACT

A combination gas valve in which means associated with the main diaphragm valve is provided for opening the valve in a stepped manner. The combination valve includes an electromagnetic operator which controls the pressure differential across the main diaphragm valve so as to open and close it. The main valve seat surrounds a concentrically located recessed secondary valve seat. Slidably located on a stem extending from the main diaphragm valve, a secondary valve plate having a plurality of orifices therein is adapted to mate with the secondary valve seat so that initial opening of the main valve allows flow only through the orifices in the secondary valve and further opening of the main valve disengages the secondary valve from its seat, thus allowing full flow. On full flow conditions, a servo regulator provides a regulated output.

3 Claims, 3 Drawing Figures

STEP OPENING GAS VALVE

BACKGROUND OF THE INVENTION

1. Field of the Invention

This invention pertains to step opening valves and in particular to servo regulated, step opening gas valves.

2. Description of the Prior Art

In the prior art, combination gas valves having a main diaphragm operated valve and a servo regulator which regulates the output pressure by controlling the pressure in a control chamber relative to the inlet pressure are well known. For example, see U.S. Pat. Nos. 3,447,755 and 3,592,225. Also in the prior art, it is well known to provide for a two stage valve in which a diaphragm opens a first valve and a lost motion connection between the diaphragm and a second valve allows the second valve to be opened when the diaphragm moves further toward the open position. See U.S. Pat. No. 3,279,498, Finally, U.S. Pat. No. 2,262,825 is pertinent for the teaching of a diaphragm shut-off valve and a plurality of poppet plates which seat on an auxiliary valve surface downstream therefrom.

SUMMARY OF THE INVENTION

It is an object of the present invention to provide a servo-regulated combination type, step-opening gas valve in which the step opening function of the valve is effected by means attached only to the main diaphragm valve. A further object of the present invention is to provide a simple auxiliary valve and seat structure for a servo regulated combination gas valve which causes the valve to open in a stepped manner. These objects and others will become apparent as the description of the invention proceeds.

In accordance with the present invention a step opening gas valve is provided in which the output is unregulated under low flow conditions and in which the main diaphragm valve is automatically stepped up to a regulated high flow condition. The step-opening function of the gas valve of the present invention is accomplished by an auxiliary valve member arranged for engagement with an auxiliary valve seat. This auxiliary valve member is a perforated poppet plate slidably mounted on a shaft attached to the main diaphragm and biased toward its valve seat by a spring. During initial opening movement of the main diaphragm, the poppet plate remains seated on the auxiliary valve seat after the main valve opens to provide an initial low flow of gas through the holes in the poppet plate. After further opening movement of the main diaphragm, a ring at the free end of the shaft engages the poppet plate to lift the latter off the auxiliary valve seat. After the poppet plate is unseated, the full gas flow is regulated in a conventional manner.

BRIEF DESCRIPTION OF THE DRAWINGS

The invention will be described in detail in the following section, and will be described in conjunction with the drawings in which.

DETAILED DESCRIPTION OF THE PREFERRED EMBODIMENT

Figure 1:
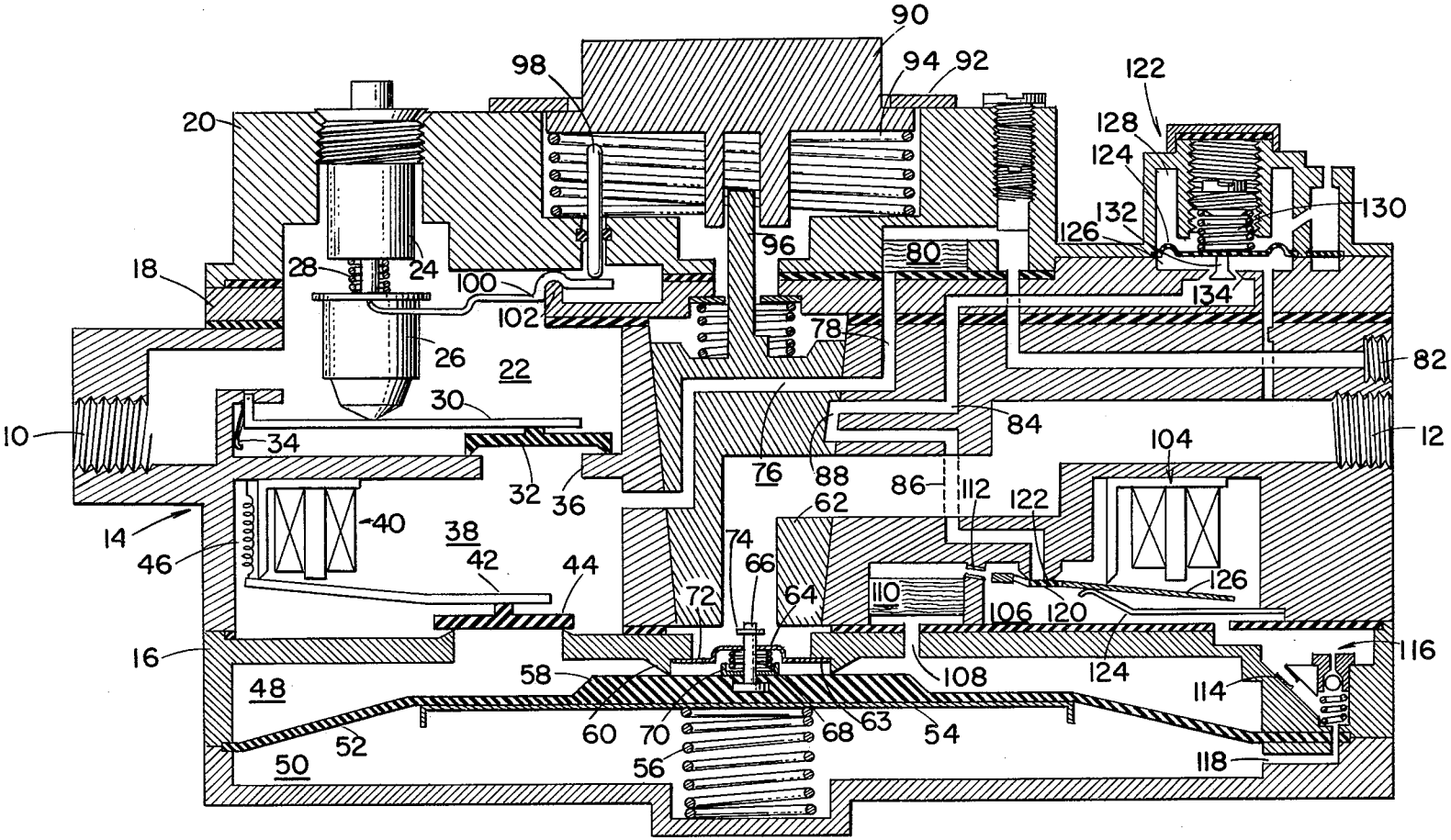
FIG. 1 is a schematic diagram of a combination type, servo-regulated, step opening gas valve in accordance with the present invention.

Referring now to the drawings, and in particular to FIG. 1, a step opening gas valve in accordance with the present invention includes a housing having an inlet 10 and an outlet 12, both of which are internally threaded so as to allow the valve to be connected in a gas supply system. The housing for the valve is essentially divided into four sections including: a central housing section 14, a lower housing section 16, an intermediate housing section 18, and an upper housing section 20. Suitable gasket material is disposed between the housing sections so as to prevent leaks between the various internal portions of the valve and the atmosphere.

The inlet 10 communicates with an inlet chamber 22 formed within housing sections 14, 18 and 20. Disposed within chamber 22 is a conventional safety valve assembly which includes electromagnetic means 24 to which a safety valve actuator 26 is attracted when the electromagnetic means is suitably energized by a thermocouple (not shown). When the safety valve actuator 26 is not attracted to electromagnetic means 24, a spring member 28 urges it downwardly. The safety valve actuator 26 abuts against lever 30, carrying safety valve 32 and is biased toward the open position by a leaf spring member 34. Safety valve 32 thus cooperates with a valve seat 36 and prevents the flow of gas from the inlet to the outlet when the pilot has failed as is well known in the art.

The safety valve seat 36 leads into a redundant valve chamber 38 in which a redundant electromagnetic valve operator 40 is located. Redundant valve operator 40 attracts lever member 42 to which redundant valve 44 is attached. It will be seen that redundant valve 44 is biased to the closed position and is opened whenever operator 40 is energized.

Housing portion 16 is divided into chamber 48 and a control chamber 50 by a diaphragm 52. A plate member 54 is attached to the underside of diaphragm 52 and a compression spring 56 urges the diaphragm 52 upwardly. A thickened portion 58 of diaphragm 52 forms a valve which cooperates with valve seat 60 so as to control flow from the output of redundant valve 44 to a rotatable plug valve 62. Valve seat 60 concentrically surrounds a recessed auxiliary valve seat 63 which cooperates with a poppet plate 64 slidably located on shaft 66 attached to diaphragm valve 58. Poppet plate 66 is biased upwardly by a compression spring 68 which concentrically surrounds shaft 66 and is held in place between a cup-shaped retainer 70 and poppet plate 64. Poppet plate 64 has a plurality of apertures 72 and is retained on shaft 66 by a ring 74 on its free end. It will be seen from further description that a low flow condition exists when poppet plate 64 is seated on seat 62 and valve 58 is open and that under the high flow condition both valve 58 and poppet plate 64 are disengaged from their respective valve seats. The poppet plate 64 thus forms a restricting valve in which flow is restricted when closed and unrestricted when opened.

Conventional plug valve 62 is rotatable between off, pilot and on positions as is well known in the art. Plug valve 62 acts to connect pilot outlet 82 to redundant chamber 38 via passageway 76 in plug valve 62, passageway 78 and filter 80; acts to connect outlet 12 to the outlet of poppet plate 64 and diaphragm valve 58; and acts to connect passageway 84 to passageway 86 via recess 88 in the surface of plug valve 62. Plug valve 62 is rotated by a handle member 90 which is also used to reset safety valve 32. Handle member 90 is biased upwardly against plate 92 by a spring member 94 and is guided on a shaft extension 96 of plug valve 62. Handle member 90 urges a pin member 98 downwardly when depressed, which, in turn, pivots a safety valve reset lever 100 on fulcrum 102 to move safety valve actuator 26 upwardly to reset the safety valve 32 as is well known in the art.

An electromagnetic bleed valve operator 104 is located in a bleed chamber 106. Bleed gas enters chamber 106 from chamber 48 by way of passageway 108, filter 110, and restriction 112 and exits by way of passageway 86. Control chamber 50 is connected to bleed chamber 106 by a restricted passageway 114 and a ball check valve 116 which are both connected to passageway 118 leading into chamber 50. Bleed gas exits from bleed chamber 106 into passageway 86 by way of bleed valve member 120 which is urged toward its seat 122 by a leaf spring member 124. Bleed valve member 120 is attached to pivotal armature member 126 which is attracted to electromagnetic operator 104 to open valve 120.

Passageways 84 and 86 and recess 88 lead from bleed valve 120 to a conventional servo regulator, generally indicated by reference numeral 122. The servo regulator 122 is well known in the art. Therefore, it should suffice to say that servo regulator 122 includes a diaphragm 124 which separates a lower chamber 126 from an upper chamber 128. The diaphragm 124 is spring biased toward the downward position by compression spring 130 and has a valve member 132 attached thereto which cooperates with seat 134. Upper chamber 128 is connected to atmosphere so as to provide a reference pressure for servo regulator 122.

From the above description of the preferred embodiment of the invention, the operation of the device will be understood by those skilled in the art. However, the operation of this device will be briefly described for sake of clarity. In the following description it will be assumed that plug valve 62 is in the "on" position and that the pilot is lit so that safety valve 32 is open.

Figure 2:
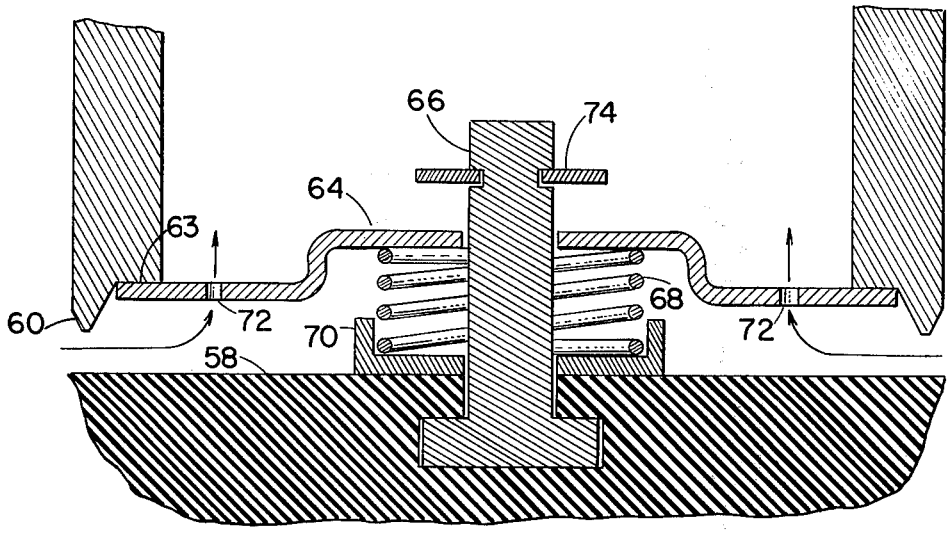
FIG. 2 is an enlarged sectional view of the auxiliary valve, auxiliary seat, main valve and main valve seat in the low flow position.

Redundant valve operator and bleed valve operator are connected in the thermostat circuit and are both energized when the thermostat contacts close, calling for heat. Inlet gas will then flow into chamber 48 and into bleed chamber 106 through passageway 108, filter 110 and restriction 112. Inasmuch as bleed valve 120 is open, gas is bled off from chamber 106 to the outlet 12 through passageways 86, 88, 84 and servo regulator 122 at a rate higher than can be supplied through restriction 112. The net result is to reduce the pressure in chamber 106 below the inlet pressure level and consequently to slowly reduce the pressure in control chamber 50. When the pressure differential between chamber 48 and control chamber 50 is great enough main diaphragm valve 58 will unseat itself from seat 60 and continue to slowly move toward the open position. At this point, gas will flow from inlet 10 to outlet 12 only through the apertures 72 in poppet plate 64 since the poppet plate remains seated on seat 62 so as to provide a low flow condition. See FIG. 2. Since servo regulator 122 is set to regulate on the high flow condition, the outlet pressure on the low flow condition is not regulated by the servo regulator 122.

Figure 3:
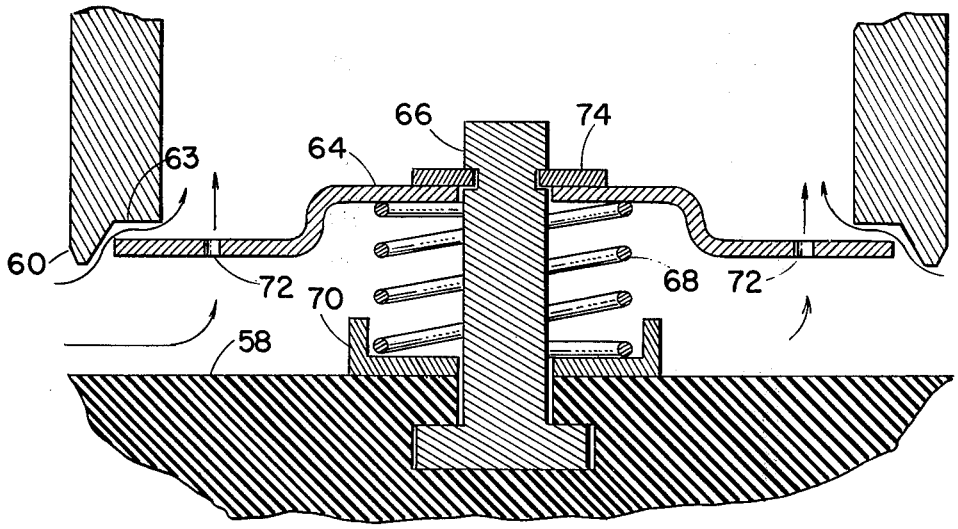
FIG. 3 is an enlarged sectional view similar to FIG. 2, but showing the components in the high flow condition.

With continued opening of the main valve 58, ring member 74 will eventually abut against the upper side of poppet plate 64 and with further movement of valve 58 toward the open position poppet plate 64 will be unseated from seat 62. Gas flows from the inlet 10 to the outlet 12 through apertures 72 and past seats 60 and 62, as indicated by the arrows in FIG. 3 after poppet plate has been unseated, so as to provide a servo regulated high flow state. When the thermostat has been satisfied and its contacts open, bleed valve 120 and redundant valve 44 are closed. Check valve 116 automatically opens as is conventional to allow the pressure in chambers 48 and 50 to rapidly equalize, thus ensuring that main valve 58 is rapidly closed.

In view of the above description of the preferred embodiment of the invention, it will be appreciated by those skilled in the art that the present invention provides a simple, reliable structure for effecting step opening of a combination gas valve. Further, it will be appreciated that main diaphragm assembly and the removably attached poppet plate structure of the present invention allows the choice at the time of manufacture as to whether or not the combination gas valve is to be step opening or not. If the valve is to be a step opening valve, the poppet plate assembly is attached to the main valve at the time of manufacture. If it is not, the poppet plate assembly is not included in the combination valve.

A preferred embodiment of the invention has been described so as to exemplify the principles of the present invention. The invention is defined in the claims.

What is claimed is:

1. In a step opening, combination type gas valve including a casing having an inlet and an outlet, a main valve seat located in said casing in the flow path between said inlet and said outlet, main diaphragm valve means located in said casing to control flow between said inlet and said outlet, said main diaphragm valve means comprising a diaphragm member separating a portion of said casing into a first chamber and a control chamber and valve means on said diaphragm adapted for cooperation with said main valve seat, spring means for normally urging said main diaphragm valve means toward said main valve seat, means for causing said main diaphragm valve means to move toward and away from said main valve seat, the improvement which comprises in combination therewith:

an auxiliary valve seat located in said casing, said auxiliary valve seat being recessed from, and concentrically located with said main valve seat;

restricting valve means for restricting the flow of gas therethrough when closed and for allowing an unrestricted flow of gas therethrough when open, said restricting valve means being adapted for cooperation with said auxiliary valve seat and further being mounted upon and operated by said main diaphragm valve means;

spring means for biasing said restricting valve means toward said auxiliary valve seat; and a lost motion connection between said main diaphragm valve means and said restricting valve means.

2. The step opening, combination type gas valve as claimed in claim 1, wherein said restricting valve means comprises:

a shaft member attached to said main diaphragm valve means; and a poppet plate having a plurality of apertures therein slidably mounted on said shaft member.

3. The said opening, combination type gas valve as claimed in claim 2, wherein said shaft member is removably attached to said main diaphragm valve means.

* * * * *